US006585181B2

(12) United States Patent
Kronenberger

(10) Patent No.: US 6,585,181 B2
(45) Date of Patent: Jul. 1, 2003

(54) BOBBIN ASSEMBLY WITH BACKLASH PREVENTING STRUCTURE

(76) Inventor: Ronald Kronenberger, 320 Portwine Rd., Riverwoods, IL (US) 60015

( * ) Notice: Subject to any disclaimer, the term of this patent is extended or adjusted under 35 U.S.C. 154(b) by 49 days.

(21) Appl. No.: 09/825,417

(22) Filed: Apr. 3, 2001

(65) Prior Publication Data

US 2002/0117569 A1 Aug. 29, 2002

Related U.S. Application Data

(63) Continuation-in-part of application No. 09/794,702, filed on Feb. 27, 2001.

(51) Int. Cl.[7] ..... B65H 54/553; B65H 59/02

(52) U.S. Cl. ..... 242/129.8; 242/147 M; 242/422.2

(58) Field of Search ..... 242/118.7, 118.2, 242/128, 129.8, 138, 147 M, 155 M, 156, 423.1, 610.4, 611, 611.1, 288, 422.2

(56) References Cited

U.S. PATENT DOCUMENTS

| | | | | | |
|---|---|---|---|---|---|
| 2,555,658 | A | | 6/1951 | Ritter | |
| 2,561,155 | A | * | 7/1951 | Thomas, Jr. et al. | 242/566 |
| 2,784,690 | A | * | 3/1957 | Brandt | 112/188 |
| 3,716,202 | A | * | 2/1973 | Thomas | 242/118.7 |
| 4,328,932 | A | * | 5/1982 | Nelson | 242/610.4 X |
| 4,434,951 | A | * | 3/1984 | Nakajima | 242/288 |
| 4,830,308 | A | * | 5/1989 | Puryear | 242/288 |
| 4,940,194 | A | * | 7/1990 | Young | 242/288 |
| 5,018,465 | A | * | 5/1991 | Hager et al. | 242/288 |
| 5,108,042 | A | * | 4/1992 | Puryear et al. | 242/288 |
| 5,301,899 | A | * | 4/1994 | Sato | 242/288 |
| 5,636,804 | A | * | 6/1997 | Jeung | 242/288 |
| 5,842,431 | A | * | 12/1998 | Wu | 112/232 |
| 6,257,512 | B1 | * | 7/2001 | Schoeck et al. | 242/610.6 X |

* cited by examiner

*Primary Examiner*—Kathy Matecki
*Assistant Examiner*—Minh-Chau Pham
(74) *Attorney, Agent, or Firm*—Wood, Phillips, Katz, Clark & Mortimer

(57) ABSTRACT

The combination of a bobbin assembly and a support for the bobbin assembly. The bobbin assembly has a core around which a supply of thread can be wrapped and having a rotational axis, a first flange having first and second oppositely facing surfaces with the first surface bounding a storage space for thread wrapped around the core, and a magnetic element. The support has a third surface with a first metal material facing the second surface with the bobbin assembly operatively connected to the support and sufficiently close to the magnetic element so that a magnetic field is generated between the magnetic element and first metal material that tends to resists movement of the bobbin assembly relative to the support around the rotational axis of the core.

20 Claims, 5 Drawing Sheets

BOBBIN ASSEMBLY WITH BACKLASH PREVENTING STRUCTURE

CROSS REFERENCE

This application is a continuation-in-part of application Ser. No. 09/794,702, filed Feb. 27, 2001, entitled "Bobbin Assembly With Backlash Preventing Structure".

BACKGROUND OF THE INVENTION

1. Field of the Invention

This invention relates to bobbin assemblies for supplies of thread as used on different sewing machines and, more particularly, to a bobbin assembly having structure which cooperates with a support for the bobbin assembly to prevent backlash of thread due to overrunning.

2. Background Art

Bobbins are used for thread supplies on a wide range of sewing equipment. Typically, the bobbin has a core with a rotational axis and axially spaced flanges which bound a storage space for thread wrapped around the core. The bobbin is mounted on a support for rotation around the core axis. By rotating the bobbin, thread wrapped around the core is controllably paid out.

Ideally, the bobbin is guidingly rotated during operation without any significant resistance as might cause uneven line distribution or, in a worse case, jamming of the bobbin. While smooth rotation of the bobbin is desirable during sewing operations, the unimpeded rotation of the bobbin potentially causes thread backlash. Ideally, as the machinery is stopped, the bobbin rotation simultaneously ceases. However, due to the free rotation of the bobbin, the momentum of the rotating bobbin causes it to continue to rotate which could produce a backlash in the thread. This may require that the machinery be shut down to allow the backlash to be eliminated. Severely backlashed thread may have to be cut. Potentially, there is a significant loss of operating time, as well as the inconvenience of having to manually remedy the backlash situation. Severe backlashing may require replacement of the bobbin with a bobbin having a new supply of thread. Consequently, significant amounts of thread may be wasted.

Potentially of greater significance is the fact that a slackened thread resulting from overrunning of the bobbin may cause at least temporary defective stitching after the equipment is re-started. This may lead to defective product that may have to either be re-stitched or destroyed.

To address this problem, it is known to install disk-like spring elements on a case which confines the bobbin into its operative position. These springs have deflectable arms which produce a frictional bias force on the bobbin. This force is preferably controlled so that it does not significantly impede rotation of the bobbin during a sewing operation yet produces enough resistance that the bobbin will not continue to rotate once the equipment is stopped, as might cause thread backlash.

SUMMARY OF THE INVENTION

In one form, the invention is directed to the combination of a bobbin assembly and a support for the bobbin assembly. The bobbin assembly has a core around which a supply of thread can be wrapped and having a rotational axis, a first flange having first and second oppositely facing surfaces with the first surface bounding a storage space for thread wrapped around the core, and a magnetic element. The support has a third surface with a first metal material facing the second surface with the bobbin assembly operatively connected to the support and sufficiently close to the magnetic element so that a magnetic field is created between the magnetic element and first metal material that tends to resist movement of the bobbin assembly relative to the support around the rotational axis of the core.

In one form, the first metal material is attracted to the magnetic element with a force that tends to resist movement of the bobbin assembly relative to the support means around the rotational axis of the core.

In one form, the magnetic element is a first discrete element on the first flange.

In one form, the first flange is made from a non-metallic material to which the first discrete element is attached.

The non-metallic material may be a moldable material, such as plastic.

In one form, the third surface is defined by a second material that is different than the first metal material.

A second magnetic element may additionally be provided on the first flange.

The invention is also directed to the combination of a bobbin assembly and a support for the bobbin assembly. The bobbin assembly has a core around which a supply of thread can be wrapped and having a rotational axis, and a first flange having first and second oppositely facing surfaces, with the first surface bounding a storage space for thread wrapped around the core. The first flange is made of a first metal material. The support has a third surface facing the second surface with the bobbin assembly operatively connected to the support and a magnetic element that is one of at or adjacent to the third surface so that a magnetic field is created between the magnetic element and first metal material that tends to resist movement of the bobbin assembly relative to the support around the rotational axis of the core.

The first metal material defines at least a part of the second surface.

The first metal material may be embedded in the first flange.

In one form, the first metal material is attracted to the magnetic element with a force that tends to resist movement of the bobbin assembly relative to the support around the rotational axis of the core.

The magnetic element may be a discrete element embedded in the support.

The invention is also directed to the combination of a bobbin assembly and a support for the bobbin assembly. The bobbin assembly has a core around which a supply of thread can be wrapped and having a central axis, a first flange having first and second oppositely facing surfaces with the first surface bounding a storage space with thread wrapped around the core, and a first magnetic element. A support has a third surface facing the second surface with the bobbin assembly operatively connected to the support and a second magnetic element that is one of at or adjacent to the third surface. The first and second magnetic elements interact to produce a force that tends to resist movement of the bobbin assembly relative to the support around the rotational axis of the core.

The force produced by the interaction of the first and second magnetic elements may be either an attractive force or a repulsive force.

The combination may further include a third magnetic element on the bobbin assembly that interacts with the second magnetic element to produce a force that tends to resist movement of the bobbin assembly relative to the support around the rotational axis of the core.

A third magnetic element may be provided on the support to interact with the first magnetic element to produce a force that tends to resist movement of the bobbin assembly relative to the support around the rotational axis of the core.

The third magnetic element may be embedded in moldable material.

The first magnetic element may be embedded in the first flange.

DETAILED DESCRIPTION OF THE DRAWINGS

Figure 1:
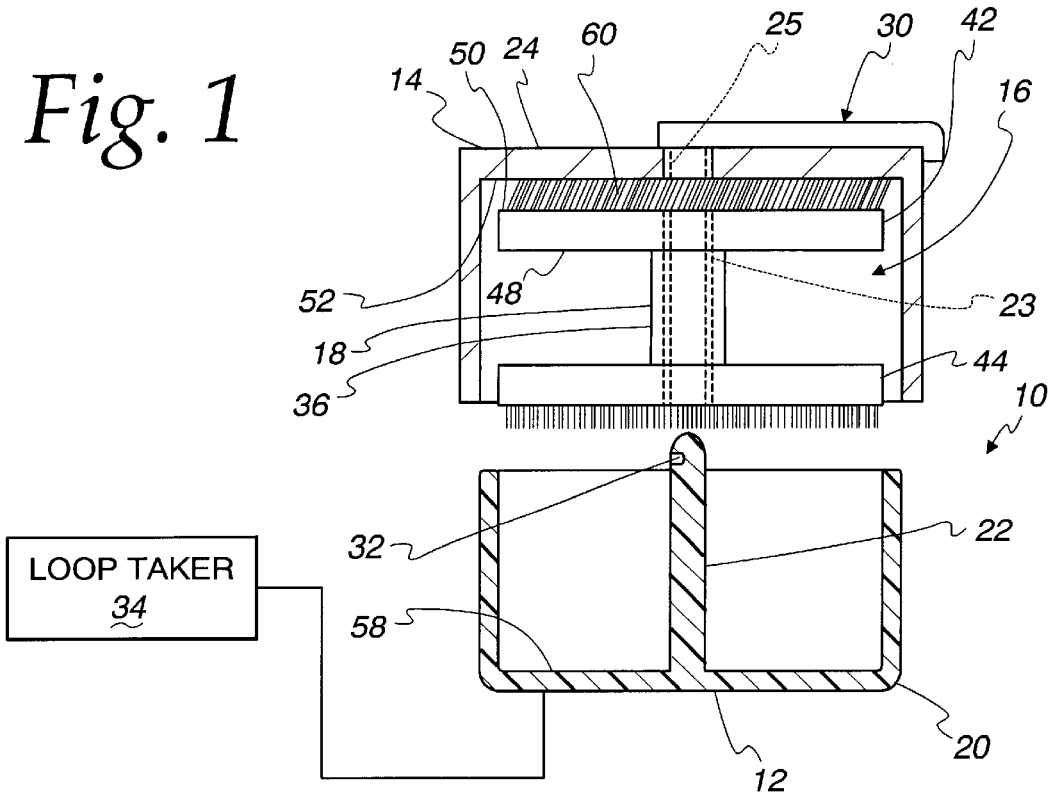
FIG. 1 is a partially schematic, exploded, partial cross-sectional view of a bobbin assembly with projections on spaced flanges thereon, according to the present invention, and with the bobbin assembly operatively connected to a bobbin basket, a bobbin case, and a loop taker.

In FIG. 1, a sewing machine assembly is shown at 10 and consists of a bobbin basket 12 and a cooperating bobbin case 14 which are matable to produce a compartment 16 for one form of bobbin assembly 18, according to the present invention. The bobbin basket 12 has a cup-shaped body 20 with a post 22 projecting upwardly therefrom for passage through a hollow sleeve 23 depending from a top wall 24 and a contiguous opening 25 through the top wall 24 of the cup-shaped bobbin case 14. The post 22 is directed through the sleeve 23 fully so as to be exposed at the top of the wall 24. A latch assembly 30 is operable to engage a notch 32 in the post 22 to prevent separation of the mated bobbin case 14 and bobbin basket 12, as with the bobbin assembly 18 operatively connected thereto and captive therebetween. A conventional loop taker 34 is operably associated with the joined bobbin basket 12 and bobbin case 14 and is useable in conventional manner, as well known to those skilled in this art.

Figure 2:
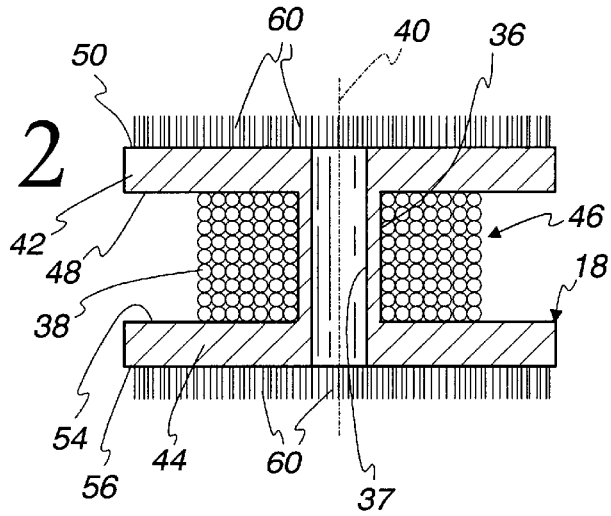
FIG. 2 is a side elevation view of the bobbin assembly in FIG. 1 with a supply of thread wrapped therearound.

The bobbin assembly 18, as seen also in FIG. 2, consists of a cylindrical core 36 around which a supply of thread 38 is wrapped. The hollow sleeve 23 extends through a bore 37 in the core 36 so that the bobbin assembly 18 is rotatable guidingly around the sleeve 23 about an axis 40 relative to the bobbin basket 12 and bobbin case 14.

The bobbin assembly 18 further consists of disk-shaped, first and second flanges 42, 44, at axial ends of the core 36 and cooperatively bounding a thread storage space 46.

The bobbin assembly construction may vary considerably in terms of its shape and composition. As one example, the entire bobbin assembly 18 can be molded or otherwise formed from one piece of plastic. Alternatively, the bobbin assembly 18 can be made from metal. As a still further alternative, the flanges 42, 44 can be made from a different material than the core 36. It is known, for example, to make the flanges 42, 44 from a paper-type material.

The bobbin basket 12 and bobbin case 14 cooperatively define a support for the bobbin assembly 18. The flange 42 has a first surface 48 that bounds the storage space 46, and an oppositely facing second surface 50. With the bobbin assembly 18 operatively connected as in FIG. 1, the first surface 48 faces a third surface 52 on the bobbin case/support 14.

The flange 44 has a surface 54 bounding the storage space 46 and an oppositely facing surface 56 which is in proximity to an oppositely facing surface 58 on the bobbin basket/support 12 with the bobbin assembly 18 operatively connected as in FIG. 1 and the bobbin basket 12 and bobbin case 14 joined to each other.

According to the invention, one or both of the surfaces 50, 56 has at least one projection 60, and in this case a plurality of projections 60. The projections 60 shown are fiber-like projections 60 which are either integrally formed with the flanges 42, 44 or separately adhered thereto, as by an adhesive. The fiber-like projections 60 may be integrally formed in a molding operation or attached as part of a sheet, or individually, as by an adhesive. The fiber-like projections 60 may be made from plastic, metal, or virtually any other type of material having sufficient integrity to remain reasonably intact after use in this environment, as described below. The projections 60 might be made from metal, or other material that is embedded in the flanges 42, 44.

The projections 60 on the first flange 42 bear against the bobbin case surface 52, whereas the projections 60 on the flange 44 bear against the surface 58 on the bobbin basket 12, with the bobbin assembly 18 operatively connected as in FIG. 1 and the bobbin basket 12 and bobbin case 24 joined to each other. The projections 60 are dimensioned so that, while they bear against the surfaces 52, 58 as the bobbin assembly 18 is rotated around the axis 40 in operation, they do not significantly impede the rotation of the bobbin assembly 18 relative to the bobbin basket 12 and bobbin case 14. At the same time, the projections 60 produce enough resistance to prevent overrunning of the bobbin assembly 18, once the machinery is stopped and thread is no longer being drawn off of the bobbin assembly 18 as might otherwise produce backlash. The projections 60 can be made of a dimension to either be maintained in their straight configuration or bent partially towards the surface from which they project, as shown for the projections 60 acting against the bobbin case surface 52 in FIG. 1. The projections 60 could also be configured to be bent against the surface from which they project.

Figure 3:
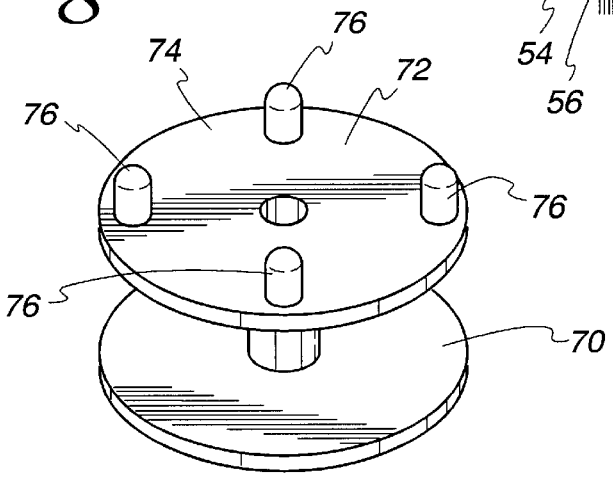
FIG. 3 is a perspective view of a bobbin assembly with an alternative form of projection on one flange thereof, according to the present invention.

In FIG. 3, a bobbin assembly 70 is shown with the same general construction as the bobbin assembly 18 and has a flange 72 with a surface 74 and a plurality of cantilevered, post-like projections 76 from the surface 74, at spaced locations, to bear against a facing support surface, such as those 52, 58, previously described. As in all embodiments described herein, the bobbin assembly 70 may be made from virtually any material, with the projections 76 likewise being made from any material that facilitates sliding movement against either of the support surfaces 52, 58 and which produces enough resistance to avoid overrunning. The projections 76 may be relatively rigid or somewhat flexible so as to be bendable during operation.

Figure 4:
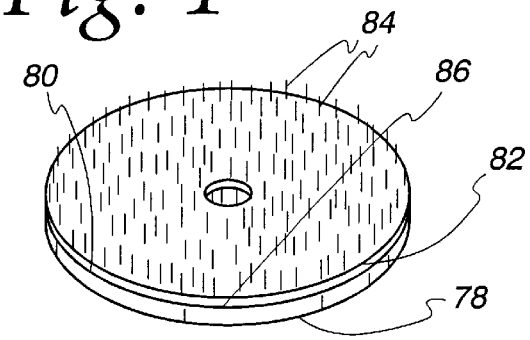
FIG. 4 is a perspective view of a flange on the inventive bobbin assembly with another form of projection thereon.
Figure 5:
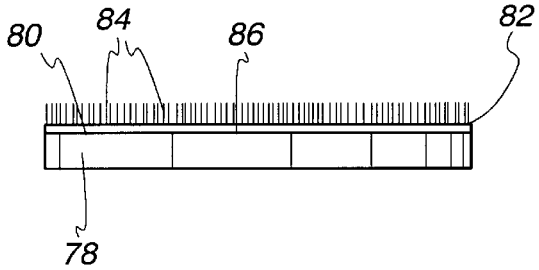
FIG. 5 is a side elevation view of the flange in FIG. 4.

In FIGS. 4 and 5, an alternative form of projection is shown on an exemplary flange 78 that may be useable on a bobbin basket to cooperative with a support surface. The flange 78 has a surface 80 which supports a layer 82 having projections 84 thereon. The layer 82 may be maintained on the flange 78 by an adhesive 86. The projections 84 may be rigid or in the form of fibers. As just one example, the layer 82 with the projections 84 thereon may be a component typically used in hook-and-loop type fasteners systems. That is, the projections 84 may be part of a hook-type element or loop-type element that is part of such a fastener system.

Figure 7:
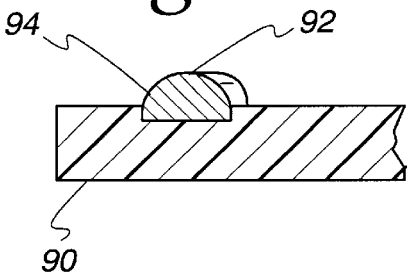
FIG. 7 is a cross-sectional view of the flange taken along line 7—7 of FIG. 6.
Figure 6:
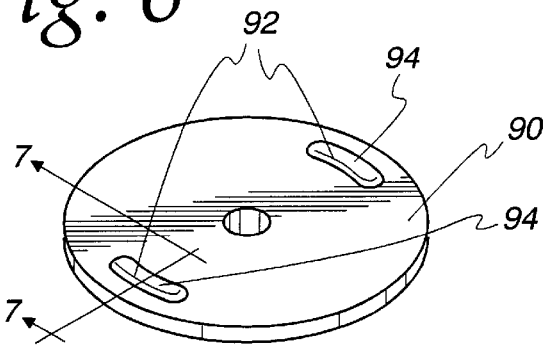
FIG. 6 is a view as in FIG. 4 of a still further form of projection which is embedded in the flange, according to the invention.

In FIGS. 6 and 7, a flange 90 is shown with ridge-like projections 92 that are embedded in the flange 90. As just one example, the material defining the flange 90 may be plastic, which is molded around each projection 92. Alternatively, the projections 92 may be frictionally held in place or held in place by an adhesive. The projections 92 shown have convex outer surfaces 94 which bear on a cooperating support surface. The number, shape and configuration of the projections 92 in FIGS. 6 and 7 may vary from that shown.

Figure 8:
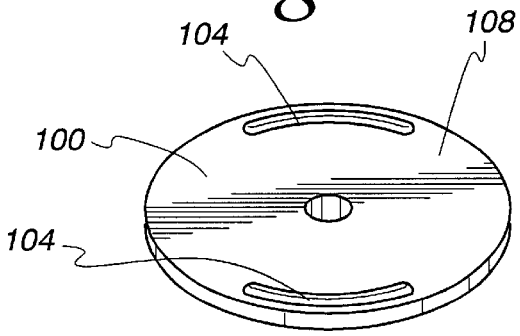
FIG. 8 is a view as in FIG. 4 of a further modified form of projection, according to the present invention.
Figure 9:
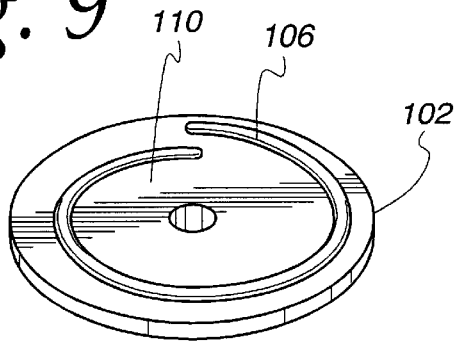
FIG. 9 is a view as in FIG. 8 of a further modified form of projection, according to the present invention.

In FIGS. 8 and 9, separate flanges 100, 102 are shown with integrally formed ridge-like projections 104, 106 from surfaces 108, 110 on the flanges 100, 102. The projections 104 have a curved shape, with the projection 106 having a continuous spiral shape. The projections 104, 106 might be separately formed and attached to the flanges 100, 102.

Figure 10:
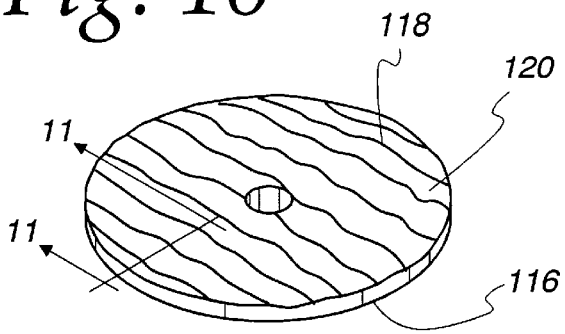
FIG. 10 is a view as in FIG. 9 with a still further form of projection, according to the present invention.
Figure 11:
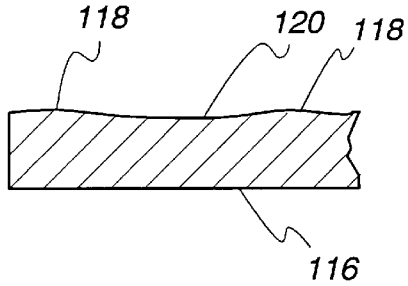
FIG. 11 is a cross-sectional view of the flange taken along line 11—11 of FIG. 10.

In FIGS. 10 and 11, a flange 116 is shown with projections 118 defined on a surface 120 thereof. In this case, the projections are formed by roughening the surface 120 by any means known to those skilled in this art.

Figure 14:
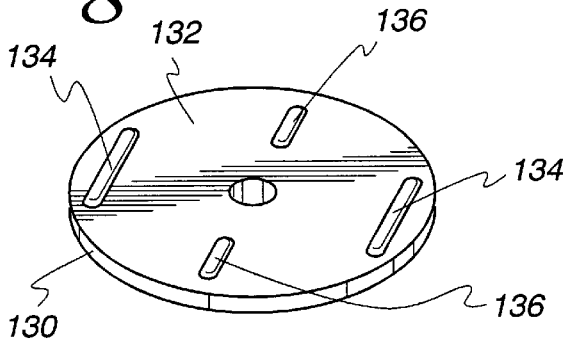
FIG. 14 is a view as in FIG. 12 of a still further modified form of projection, according to the invention.

In FIG. 14, a flange 130 is shown with a surface 132 having another form of projection, including long and short, generally straight, ridge-like projections, 134, 136. As in all embodiments, the projections 134, 136 may be integrally formed, molded in place, or attached as by an adhesive.

Figure 13:
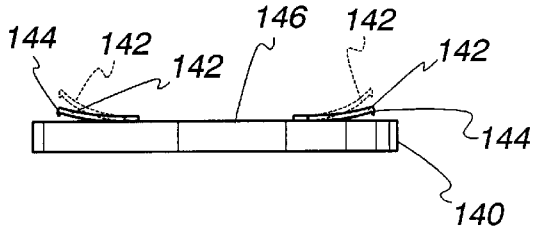
FIG. 13 is a side elevation view of the flange in FIG. 12.
Figure 12:
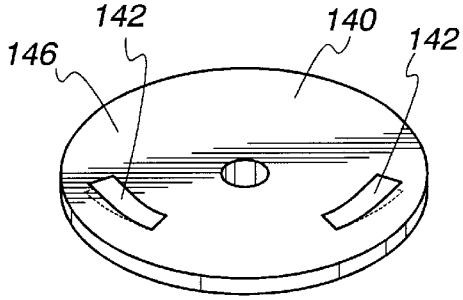
FIG. 12 is a view as in FIG. 10 of a still further modified form of projection, according to the present invention.

In FIGS. 12 and 13, a flange 140 is shown with projections 142 in the form of spring-type elements with offset free ends 144. The free ends 144 are biased upwardly and are urged under a captive force slightly downwardly towards a flange surface 146 from which they project with the bobbin assembly on which the flange 140 is provided operatively connected to a support therefor.

One or both of the projections 142 shown may be made from a shape-retentive material, such as thin metal, which can be placed and maintained in a plurality of different configurations, as shown for example in dotted lines in FIG. 13, to thereby vary the resistive force.

Figure 15:
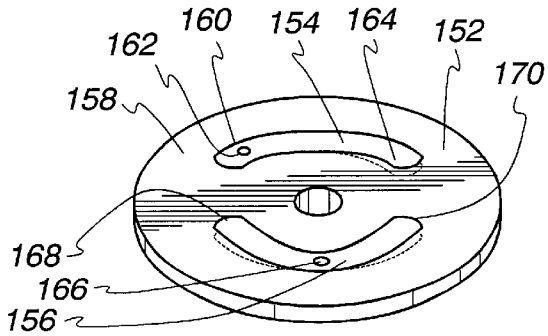
FIG. 15 is a view as in FIG. 14 of a still further modified form of projection, according to the present invention.
Figure 16:
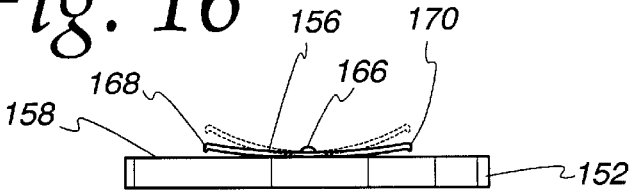
FIG. 16 is a side elevation view of the flange of FIG. 15.

In FIGS. 15 and 16, a flange 152 is shown with a pair of projections 154, 156 from a surface 158. The projection 154 has an end 160 secured to the surface 158, as by a fastener 162, and a free end 164 that is bent upwardly, and preferably reconfigurable as the projections 142 in FIGS. 12 and 13.

The projection 156 has a fastener 166 which maintains a central portion thereof attached to the surface 158, and spaced free ends 168, 170, corresponding to those 144 previously described, and projecting upwardly from the surface 158 to be biased against a cooperating support surface. The free ends may be reconfigurable and made from a shape-retentive material that can be reconfigured, or a spring-type material which tends towards a single configuration.

In all the embodiments shown, the bobbin assemblies, according to the present invention, can be operatively connected so that the projections on the flange surfaces thereon abut to a surface on a cooperating support to guide, yet not significantly inhibit, rotation of the bobbin relative to the support. The projections shown are but exemplary of the many different types of projections contemplated by the invention. It is desirable that, regardless of the shape of the projection, the projection(s) occupy an area on its associated flange surface that is less than the area of that flange surface.

Figure 17:
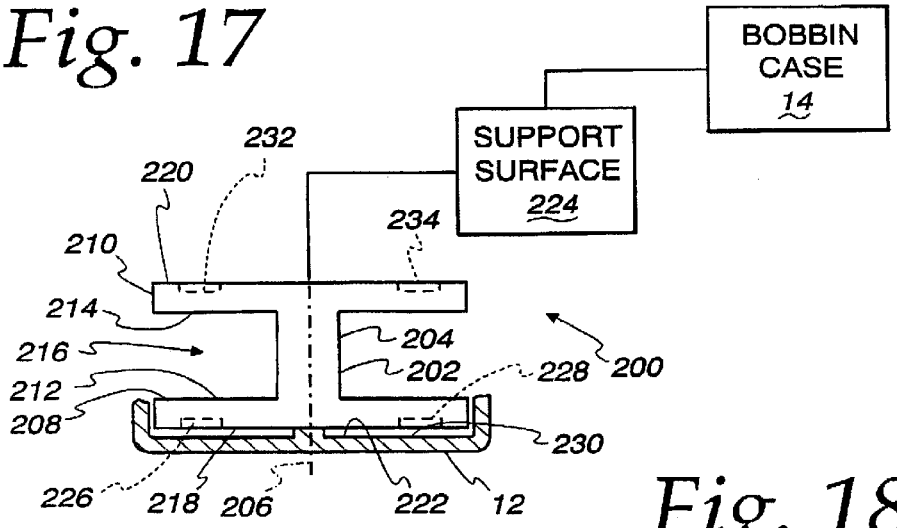
FIG. 17 is a partially schematic, partial cross-sectional view of a modified form of bobbin assembly, according to the present invention, operatively connected to a bobbin basket and bobbin case as in FIG. 1 and utilizing magnetic elements.
Figure 18:
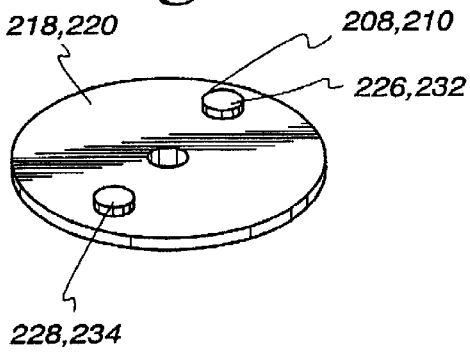
FIG. 18 is a perspective view of one of the flanges on a bobbin basket as in FIG. 17 and showing magnetic elements thereon, according to the present invention.

In FIGS. 17 and 18, a further modified form of sewing machine assembly, according to the present invention, is shown at 200. The sewing machine assembly 200 consists of a bobbin assembly 202, having a construction corresponding to that of the bobbin assembly 18, previously described, and including a cylindrical core 204 having a rotational axis 206, and axially spaced flanges 208, 210 with axially facing surfaces 212, 214 cooperatively bounding a thread storage space 216. Flange surfaces 218, 220 face axially oppositely to the surfaces 212,214 and are situated in adjacent, facing relationship with support surfaces 222, 224 on the aforementioned bobbin basket 12 and bobbin case 14 with the bobbin assembly 202 operatively connected to the bobbin basket 12 and bobbin case 14.

Discrete magnetic elements 226, 228 are embedded in the flange 208 at diametrically opposite locations. In this embodiment, the magnetic elements 226, 228 are embedded in the flange 208 so as to be flush with the surface 218. The magnetic elements 226, 228 generate a magnetic field in the space 230 between the facing bobbin assembly and bobbin basket surfaces 218, 222.

In this embodiment, the bobbin basket 12 is shown made entirely from a metal material which may or may not be attracted to the magnetic elements 226, 228. The resulting magnetic field produces a force that tends to resist movement of the bobbin assembly 202 around the axis 206 relative to the bobbin basket 12. The system is designed so that there is a slight resistance to rotation that reduces the likelihood of thread backlash which does not significantly impede the free relative rotation between the bobbin assembly 202 and the bobbin basket 12. At the same time the system can be designed to produce a controlled resistance to rotation of the bobbin assembly 202 to thereby selectively control thread tension.

A like arrangement of magnetic elements 232, 234 may be provided on the flange 210 to cooperate with the metallic material on the bobbin case 14. The magnetic elements 232, 234 are likewise shown to be embedded in the bobbin assembly 202 so as to be flush with the flange surface 220. This embedding is facilitated by forming the bobbin assembly 202 from a moldable material that can be formed around the magnetic elements 226, 228, 232 and 234 in a well known manner. The bobbin assembly 202 may be made from plastic or any other moldable material. Alternatively, the magnetic elements 226, 228, 232, 234 could be mounted in a pre-formed receptacle in a non-moldable material, or surface mounted, as hereafter described.

The metallic material defining the bobbin basket 12 and bobbin case 14 may either be attractive or unattractive to the magnetic elements 226, 228, 232 and 234. In the latter case, the entire bobbin basket 12 and bobbin case may be made from the metallic material. This allows a magnetic field to be generated in the spaces between the bobbin assembly 202 and the bobbin basket 12 and the bobbin assembly 202 and bobbin case 14.

In the event that the metal material on the bobbin basket and the bobbin case 14 is attractive to the magnetic elements 226, 228, 232 and 234, it is desirable, though not required, that the metal material on the bobbin basket 12 and bobbin case 14 be provided as one or more discrete elements attached thereto.

In FIG. 18, a modification to the flanges 208, 210 is shown wherein the magnetic elements 226, 228, 232 and 234 project outwardly from the associated surfaces 218, 220 as opposed to being flush therewith as in FIG. 17.

Figure 19:
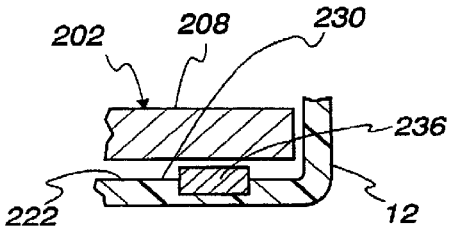
FIG. 19 is a fragmentary, cross-sectional view of a modified form of bobbin assembly and support, according to the present invention, and showing the cooperation between one of the bobbin basket flanges and a magnetic element on the bobbin case.

In FIG. 19, the bobbin basket 12 is shown to be made from a plastic material. A magnetic element 236, corresponding to the magnetic elements 226, 228, is embedded in the bobbin basket 12 so as to protrude outwardly from the surface 222 into the space 230. In this embodiment, the flange 208 on the bobbin assembly 202 is shown to be made entirely of metal to cooperate in the manner previously described. That is, the magnetic element 236 is designed to generate a magnetic field within the space 230 without attracting the flange 208 or may attract the flange 208 with a force calculated to generate a retarding force without significant impedance to rotational movement.

Figure 20:
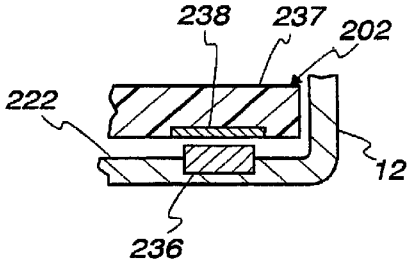
FIG. 20 is a view as in FIG. 19 of a further modified form of the invention wherein the bobbin basket is made from a plastic material having a metallic element attached thereto.

In FIG. 20, a modified flange, corresponding to the flange 208 of FIG. 19, is shown at 237. Rather than making the entire flange 237 from metal, the flange 237 is made from plastic, or other material, and has embedded therein a metallic element 238 which preferably radially coincides with the location of the magnetic element 236 to produce the retarding force, as previously described. One or more of the metallic elements 238 may be embedded in the flange 237 with a combined circumferential extent partially or fully around the axis 206. Discrete metallic elements 238 may be provided with a circumferential extent that is dictated by the degree of retardation of the rotational movement of the bobbin assembly 202 that is desired.

It should be understood that while variations are described with respect to the cooperation between the bobbin assembly 202 and the bobbin basket 12, the same construction can be used between the flange 210 and the bobbin case 14. As just one example, as shown in FIG. 21, the flange 210 is shown with the magnetic elements 232, 234 cooperating with a metallic surface 224 on the bobbin case 14.

Figure 21:
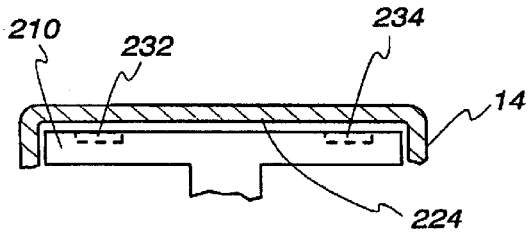
FIG. 21 is a fragmentary, partial cross-sectional view of a bobbin assembly as in FIG. 17 and operatively connected to the bobbin case according to the invention.
Figure 22:
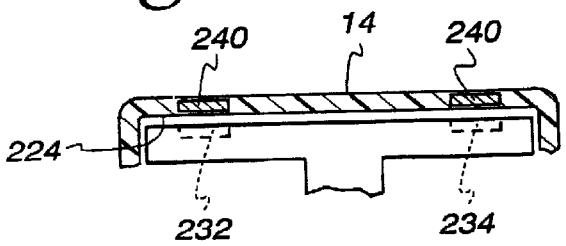
FIG. 22 is a view as in FIG. 21 of a modified form of the invention wherein the bobbin case of FIG. 21 is made from a plastic material and has metallic elements embedded therein.

In FIG. 22, the system in FIG. 21 is modified by making the bobbin case 14 from plastic, or other non-metallic material, in which one or more discrete metallic elements 240 are embedded in radial overlap with the magnetic elements 232, 234. In this embodiment, the metallic elements 240 are fully embedded so that they are not directly exposed at the support surface 224 on the bobbin case 14.

Figure 23:
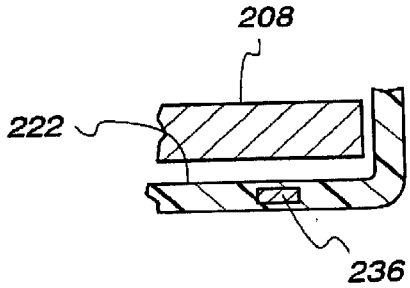
FIG. 23 is a view as in FIG. 19 of a further modified form of the invention with a magnetic element fully embedded in the bobbin case.

In FIG. 23, a variation from the structure in FIG. 19 is shown wherein the magnetic element 236 is embedded and fully surrounded, as by a plastic material, so as not to be directly exposed at the surface 222.

Figure 24:
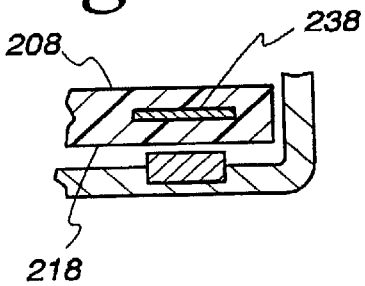
FIG. 24 is a view as in FIG. 20 with the metallic element on the bobbin assembly embedded so as to be fully surrounded by material defining the bobbin basket.

In FIG. 24, variation of the structure in FIG. 20 is shown wherein a metallic element 238 is embedded in the flange 208 and fully surrounded by the material defining the flange 208, so as not to be directly exposed at the flange surface 218.

Figure 25:
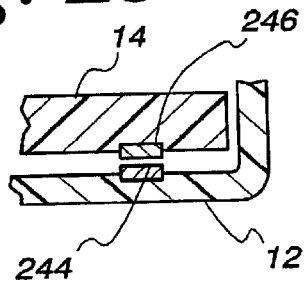
FIG. 25 is a view as in FIG. 24 showing magnetic elements on the bobbin assembly/bobbin case, according to the invention, which cooperate to retard relative rotational movement between the bobbin assembly and bobbin case.
Figure 26:
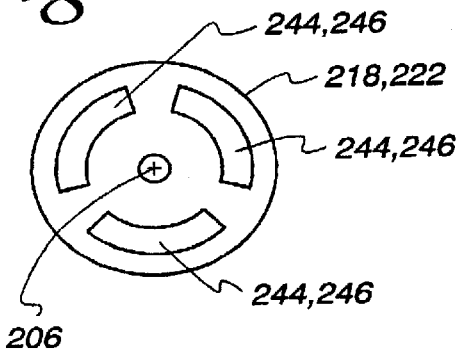
FIG. 26 is an end view of magnetic elements on the bobbin assembly and bobbin case according to the present invention.

In FIGS. 25 and 26, a further modification, according to the present invention, as shown wherein cooperating magnetic elements 244, 246 are embedded in the bobbin basket 12 and bobbin case 14, shown in this case to be plastic, but not limited to this composition. The magnetic elements 244, 246 may be such as either to attract or repel each other. This mutual attraction or repulsion produces an impedance to the free relative rotation between the bobbin basket 12 and bobbin case 14.

In FIG. 26, the magnetic elements 244, 246 are shown in the form of discrete, arcuate elements which are circumferentially spaced around the axis 206.The shape and circumferential extent of the magnetic elements 244, 246 is dictated by the desired retarding force.

Figure 27:
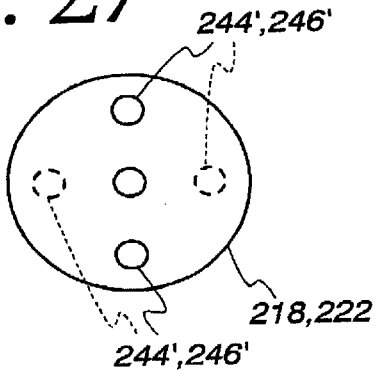
FIG. 27 is a view as in FIG. 26 with a modified form of magnetic elements, according to the invention.

As another example, as shown in FIG. 27, corresponding magnetic elements 244', 246' have a circular cross section, with the diameter, number and location being dictated by the desired retarding force.

Figure 28:
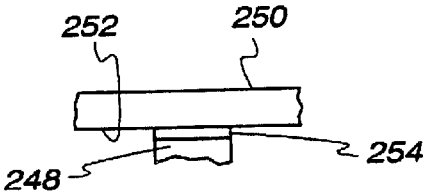
FIG. 28 is a fragmentary, elevation view showing a magnetic element, attached to a surface as by adhesive, according to the invention.

As an alternative to embedding the magnetic elements, each of the magnetic elements described above, and shown generically at 248 in FIG. 28, can be attached to an associated support or flange 250 on an external surface 252 thereof, as by the use of an adhesive 254.

All of the above designs lend themselves to controlling bobbin assembly rotation to avoid thread backlash and/or control thread tension.

The foregoing disclosure of specific embodiments is intended to be illustrative of the broad concepts comprehended by the invention.

What is claimed is:

1. In combination:

a) a bobbin assembly comprising:

i) a core around which a supply of thread can be wrapped, the core having a rotational axis;

ii) a first flange having first and second oppositely facing surfaces, the first surface bounding a storage space for thread wrapped around the core; and iii) a magnetic element;

b) a support for the bobbin assembly, said support comprising:

i) a third surface comprising a first metal material facing the second surface with the bobbin assembly operatively connected to the support and sufficiently close to the magnetic element so that a magnetic field is generated between the magnetic element and first metal material so as to generate a force that resists movement of the bobbin assembly relative to the support around the rotational axis of the core to a degree that the force does not significantly impede free relative rotation between the bobbin assembly and support but resists rotation to reduce the likelihood of thread backlash; and c) a loop taker for drawing thread off of the bobbin assembly by causing rotation of the bobbin assembly.

2. The combination according to claim 1 wherein the first metal material is attracted to the magnetic element.

3. The combination according to claim 1 wherein the magnetic element comprises a first discrete element on the first flange extending through less than 360° around the rotational axis.

4. The combination according to claim 3 wherein the first flange is made from a non-metallic material to which the first discrete element is attached.

5. The combination according to claim 4 wherein the non-metallic material comprises a moldable material.

6. The combination according to claim 5 wherein the non-metallic material comprises plastic.

7. The combination according to claim 1 wherein the third surface comprises a second material that is different than the first metal material.

8. The combination according to claim 1 further comprising a second magnetic element on the first flange.

9. In combination:

a) a bobbin assembly comprising:

i) a core around which a supply of thread can be wrapped, the core having a rotational axis;

ii) a first flange having first and second oppositely facing surfaces, the first surface bounding a storage space for thread wrapped around the core, wherein the first flange comprises a first metal material;

b) a support for the bobbin assembly, said support comprising:

i) a third surface facing and adjacent the second surface with the bobbin assembly operatively connected to the support; and ii) a magnetic element that is one of at or adjacent to the third surface so that a magnetic field is generated between the magnetic element and first metal material so as to generate a force that resists movement of the bobbin assembly relative to the support around the rotational axis of the core to a degree that the force does not significantly impede free relative rotation between the bobbin assembly and support but resists rotation to reduce the likelihood of thread backlash; and c) a loop taker for drawing thread off of the bobbin assembly by causing rotation of the bobbin assembly.

10. The combination according to claim 9 wherein the first metal material defines at least a part of the second surface.

11. The combination according to claim 9 wherein the first metal material is embedded in the first flange.

12. The combination according to claim 9 wherein the first metal material is attracted to the magnetic element.

13. The combination according to claim 9 wherein the magnetic element comprises a discrete element embedded in the support.

14. In combination:

a) a bobbin assembly comprising:

i) a core around which a supply of thread can be wrapped, the core having a rotational axis;

ii) a first flange having first and second oppositely facing surfaces, the first surface bounding a storage space for thread wrapped around the core; and iii) a first magnetic element;

b) a support for the bobbin assembly, said support comprising:

i) a third surface facing the second surface with the bobbin assembly operatively connected to the support; and ii) a second magnetic element that is one of at or adjacent to the third surface, the first and second magnetic elements interacting to produce a force that resists movement of the bobbin assembly relative to the support around the rotational axis of the core to a degree that the force does not significantly impede free relative rotation between the bobbin assembly and support but resists rotation to reduce the likelihood of thread backlash; and c) a loop taker for drawing thread off of the bobbin assembly by causing rotation of the bobbin assembly.

15. The combination according to claim 14 wherein the force produced by the interaction of the first and second magnetic elements is an attractive force.

16. The combination according to claim 14 wherein the force produced by the interaction of the first and second magnetic elements is a repulsive force.

17. The combination according to claim 14 further comprising a third magnetic element on the bobbin assembly that interacts with the second magnetic element to produce a force that resists movement of the bobbin assembly relative to the support around the rotational axis of the core.

18. The combination according to claim 17 wherein the third magnetic element is embedded in a moldable material.

19. The combination according to claim 14 further comprising a third magnetic element on the support that interacts with the first magnetic element to produce a force that resists movement of the bobbin assembly relative to the support around the rotational axis of the core.

20. The combination according to claim 14 wherein the first magnetic element is embedded in the first flange.

* * * * *